United States Patent [19]

Reindel

[11] Patent Number: 4,897,623

[45] Date of Patent: Jan. 30, 1990

[54] NON-CONTACTING PRINTED CIRCUIT WAVEGUIDE ELEMENTS

[75] Inventor: John Reindel, San Diego, Calif.

[73] Assignee: The United States of America as represented by the Secretary of the Navy, Washington, D.C.

[21] Appl. No.: 181,126

[22] Filed: Apr. 13, 1988

[51] Int. Cl.[4] ..... H01P 1/207

[52] U.S. Cl. ..... 333/208; 333/248

[58] Field of Search ..... 333/208–212, 333/248

[56] References Cited

U.S. PATENT DOCUMENTS

| | | | |
|---|---|---|---|
| 2,924,792 | 2/1960 | Gyorgy | 333/208 X |
| 3,909,754 | 9/1975 | Chapell | 333/248 X |
| 4,260,967 | 4/1981 | Flieger | 333/208 |
| 4,396,896 | 8/1983 | Williams | 333/212 |
| 4,496,876 | 1/1985 | Young | 333/208 X |
| 4,500,859 | 2/1985 | Ren et al. . | |
| 4,520,329 | 5/1985 | D'Oro et al. | 333/135 |
| 4,538,123 | 8/1985 | Mariani et al. | 333/208 |

*Primary Examiner*—Marvin L. Nussbaum

*Attorney, Agent, or Firm*—Harvey Fendelman; Thomas Glenn Keough

[57] ABSTRACT

Arrays of printed circuit elements are placed in the E-plane inside waveguides to reflect and pass selected bands of frequencies. The elements make no contact with the guide walls but are suspended on dielectric substrates and are held in place with foam dielectric.

15 Claims, 4 Drawing Sheets

NON-CONTACTING PRINTED CIRCUIT WAVEGUIDE ELEMENTS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of waveguides and, more specifically, to waveguide filter elements. Conventional waveguide filters use elements that are in electrical and mechanical contact with the waveguide walls. Typical examples of these types of filters include inductive posts and inductive irises. These reactive elements are realized by means of metal rods or plates that are inserted into carefully machined openings and bonded to the walls of the waveguide by means of soldering, welding or compression techniques. Newer printed circuit waveguide filters also use such elements that are printed on substrates that are held suspended between the waveguide walls with firm metallic contacts at the walls. These filters, known as finline filters are simpler to make than irises and inductive posts but also require very precise machining to split the waveguide and cut the groove for supporting the substrate. Because the foregoing described type of filter elements are in contact with the waveguide walls and because currents flow in the junctions between the elements and the waveguide walls, and because of junction imperfections, the filter loss and reflection quality are often degraded.

SUMMARY OF THE INVENTION

The present invention overcomes the foregoing problems associated with conventional waveguide filters by providing a printed circuit filter element for a family of waveguide filters that does not require any contact with the waveguide walls. The filters can be assembled by inserting a foam backed printed circuit within a short section of waveguide. The present invention not only facilitates very simple assembly techniques and eliminates practically all costly machining that is usually associated with waveguide filters, but it also provides the highest attainable performance in terms of low losses and high reflection because the losses due to element contact resistance are eliminated.

The present invention extends the use of printed circuit filters to the upper millimeter wave frequencies because it eliminates the requirements for precise machining. Circuit tolerances for the present invention can be determined by the photolithographic processes used to form the printed circuit and can be maintained to a small fraction on the order of a thousandth of an inch, which is adequate for operation at frequencies above 220 GHz.

The foregoing advantages are accomplished in one embodiment of the present invention by providing an array of dipole-like elements which are formed as a printed circuit on a dielectric substrate positioned within a waveguide by means of dielectric foam spacer material. The use of these dipole-like elements at millimeter wave frequencies has the additional advantage that the elements can be made relatively large, about one-half wavelength along and utilize a spacing greater than one-quarter wavelength thereby minimizing element tolerances. Shapes other than dipole-like elongate elements such as C-shaped elements are disclosed.

The present invention also facilitates utilizing more than one substrate containing the printed circuit of the present invention inside a waveguide to thereby enable variability in the spacing between the elements in order to achieve the best performance.

OBJECTS OF THE INVENTION

Accordingly, it is the primary object of the present invention to disclose a printed circuit filter element for a family of waveguide filters that do not require any contact with the waveguide walls.

It is a further object of the present invention to disclose millimeter wave filters that have lower loss, high Q and lower manufacturing cost than conventional waveguide filters that use contacting filter elements.

Another object of the present invention is to disclose waveguide filters that obviate the necessity for splitting waveguides during manufacture in order to accommodate filters and also obviate the necessity for cutting a groove required for supporting the dielectric substrate as is used in conjunction with waveguide filter elements that contact the waveguide walls.

These and other objects of the invention will become more readily apparent from the ensuing specification when taken with the appended claims and the attached drawings.

DESCRIPTION OF THE PREFERRED EMBODIMENT

The present invention generally comprises an array of printed circuit elements on a dielectric substrate. The dielectric substrate is positioned within a section of waveguide and held in position by dielectric foam material. In one embodiment, the elements can be likened to dipole radiators or half wavelength radiators that are "floated" inside the waveguide by means of the substrate and low pass dielectric foam. The circuit elements printed on the dielectric substrate may be formed by means of standard photolithographic processes as is well known. The substrate thickness may be very small to prevent dielectric losses, typically on the order of 0.005 inches.

The critical design parameters of the elements in the array of each of the filters in accordance with the present invention are the length of the elements, the spacing between the elements, the shape of the elements, the width of the elements and the angular orientation of the elements relative to the E-fields of the waveguide. The degree of coupling to the elements is determined by their orientation with respect to the waveguide as will be described further below. Thus, for very lightly coupled filters as needed for narrow stopband filters the elements are nearly in line with the waveguide, i.e. practically positioned parallel with respect to the waveguide broadwalls and along the longitudinal axis of the waveguide. Tightly coupled filter elements may, for example, be positioned in line with the E-fields of the guide as will be described further below. The spacing between the elements may vary according to applications but generally should be in the range between $\frac{1}{4}$ wavelength for tightly coupled elements which may be varied between $\frac{3}{4}$ or 5/4, wavelengths when the elements are inclined steeply.

Figure 1:
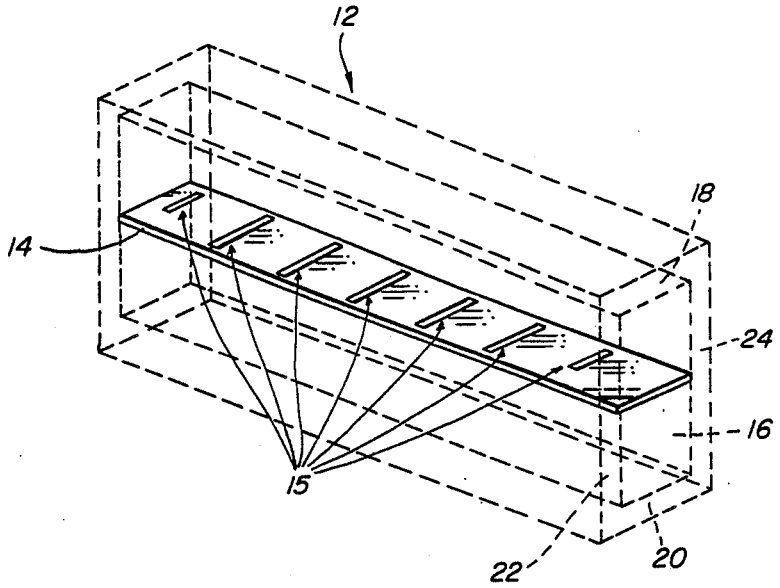
FIG. 1 is an isometric phantom view of a section of rectangular waveguide containing a dielectric substrate with an array of elements printed thereon in accordance with the present invention.

Referring now to FIG. 1 a filter assembly in accordance with the present invention is illustrated by way of example. The filter assembly is positioned within a section of rectangular waveguide 12. The filter assembly of the present invention is formed on a dielectric substrate 14 containing a printed element array shown by way of example as array 15. Depending on the operating frequency range of the waveguide, the elements of array 15 can be either shaped straight as illustrated or L-shaped (not shown). The dielectric substrate 14 is held in position within the waveguide by foam dielectric material 16 placed between the dielectric substrate 14 and the waveguide walls. The dielectric substrate 14 is oriented parallel to the waveguide narrow walls 18 and 20 and perpendicular to the waveguide broadwalls 22 and 24 as is illustrated in FIG. 1. Further, the dielectric substrate containing the circuit elements of the present invention is positioned in the example of FIG. 1 midway between the waveguide narrow walls 18 and 20 and oriented generally in the same direction as the E-field within the waveguide.

Figure 2A:
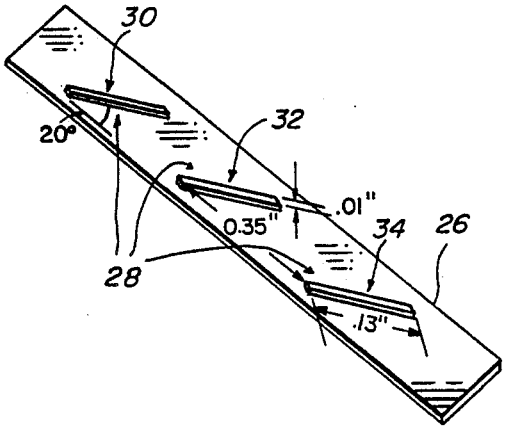
FIG. 2A is an isometric view of a dielectric substrate in accordance with the present invention with an array of filter elements comprising a bandstop filter in accordance with the present invention.

FIG. 2A illustrates an isometric view of a dielectric substrate having an array of filter elements printed thereon such that the array 28 comprises a bandstop filter. The array of circuit elements 28 may be printed either on the top side of dielectric substrate 26 alone or congruently on both sides of the substrate. The array 28 of elements is comprised of elongate dipole-like conductive strips 30, 32 and 34 with lengths, width, spacing and angles of orientation shown by way of example in FIG. 2A. The dimensions illustrated in FIG. 2A given by way of example are suitable dimensions for a 30–32 GHz bandstop filter. For bandstop filter applications the filter element length should be approximately one-half wavelength. The inter-element spacing between the elements of the array 28 should be approximately 5/4 wavelengths. The angle of inclination determines the degree of coupling and hence the width of the stopband. Impedance matching and coupling to the waveguide may be improved by shortening the length of the outside low pass elements 30 and 34 and/or by adjusting the inter-element spacing (not shown). A filter such as the type illustrated in FIG. 2A designed for the Ka band typically has less than one-half dB loss in the passbands 26–30 GHz and 32–40 GHz and greater than 40 dB rejection from 30.5 to 31.5 GHz.

Figure 2B:
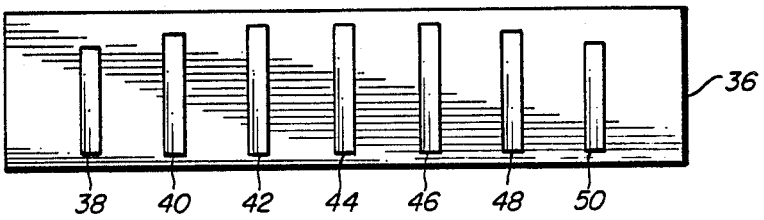
FIG. 2B is a top view of a dielectric substrate containing an array of elements comprising a lowpass filter in accordance with the present invention.
Figure 2C:
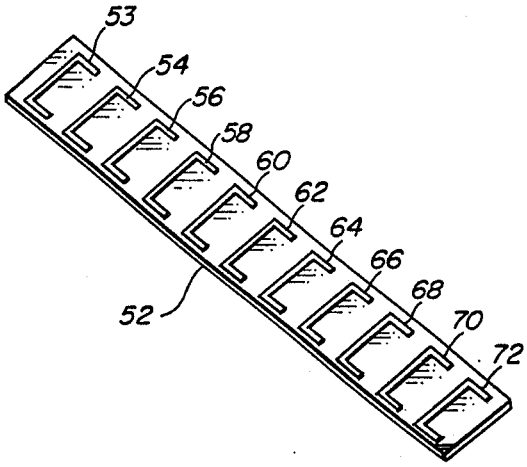
FIG. 2C is an isometric view of a dielectric substrate with an array of printed circuit elements comprising a high pass filter in accordance with the present invention.

Referring to FIG. 2B a low pass filter implementation of the present invention is illustrated. The low pass filter is formed on dielectric substrate 36 which has an array of circuit elements 38, 40, 42, 44, 46, 48 and 50 formed on the substrate. The broadband low pass filter illustrated in FIG. 2B has a passband $f_1$-$f_2$, where $f_1$ is the waveguide cut-off frequency and $f_2$ is the frequency at which the element length is approximately one-half wavelength. This length, which determines the filter corner frequency, typically varies from 0.10 inches at 28 GHz to 0.06 inches at 40 GHz. By lengthening the filter elements beyond the half wavelength as shown in the filter of FIG. 2C described more fully below selected high pass characteristics can be achieved. Further, impedance matching to the waveguide within which the filter is positioned is facilitated by varying the length of the elements such that the elements at the distal ends of the filter are shorter than the elements in the middle of the filter. Specifically, by way of example, filter elements 38 and 50 may have a length that is 60 percent of the length of the inner filter elements 42, 44 and 46. Filter elements 40 and 48 may have a length that is on the order of 90 to 95 percent of the length of the elements 42, 44 and 46. For the low pass filter implementation illustrated in FIG. 2B the elements are oriented parallel to the waveguide narrow walls and perpendicular to the waveguide broadwalls. Further impedance matching can be accomplished by varying the width of the circuit elements such that the elements at the ends of the filter are thinner than the inner elements of the array. Further, inter-element spacing can be varied to achieve impedance matching with the waveguide. For instance, the outer elements 38 and 40 and 8 and 50 can be positioned closer together than the inner elements 42, 44 and 46.

Figure 5:
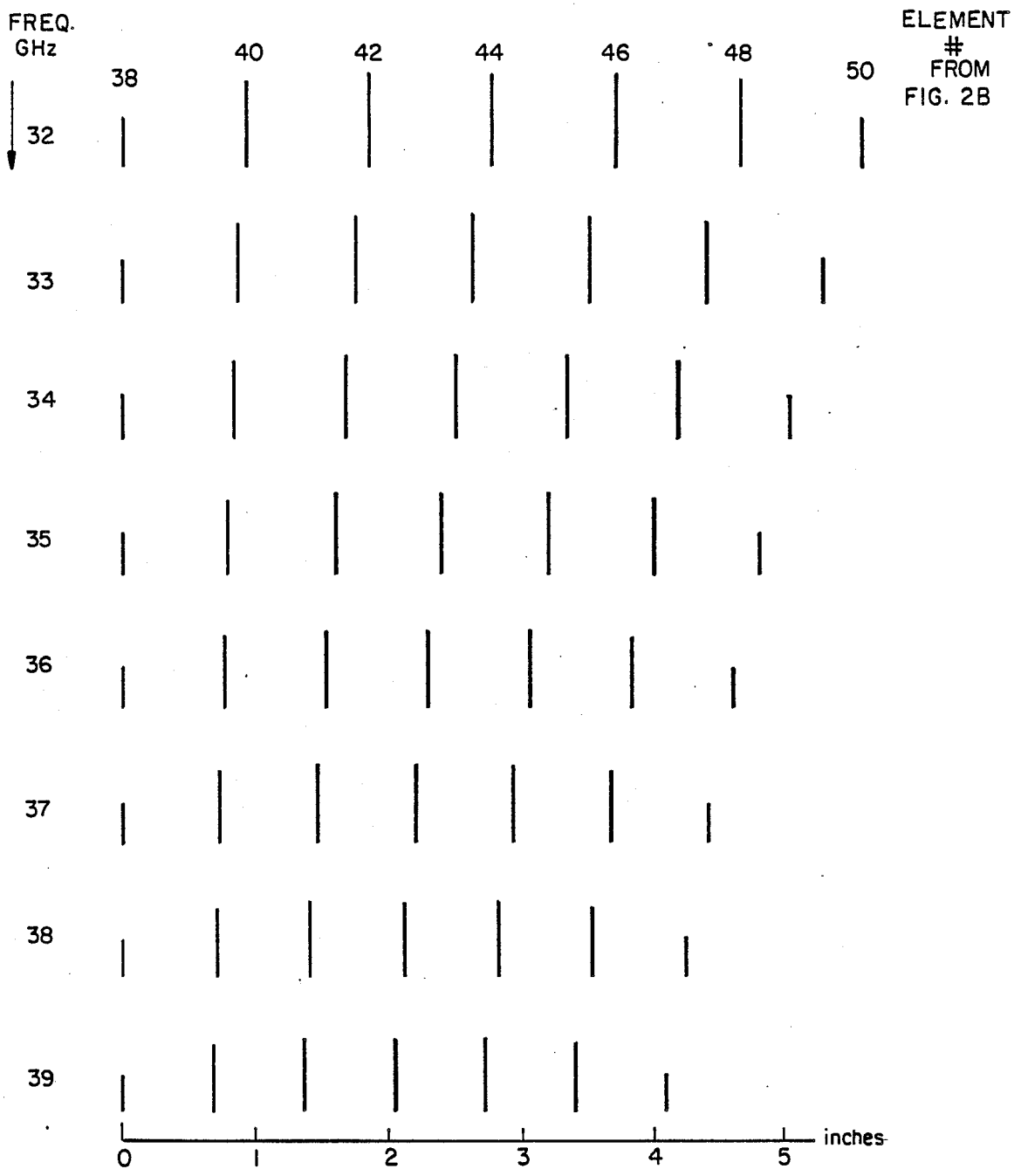
FIG. 5 is a chart showing in 10x magnification various arrays of elements for the frequency ranges 32–39 GHz suitable for use as low pass filters as shown in FIG. 2B.

FIG. 5 shows various arrays of low pass filter elements 38, 40, 42, 44, 46, 48 and 50 for the frequency ranges 32–39 GHz. The inter-element spacings and element lengths and widths are shown by the 5 inch scale at the bottom of the drawing which is a 10x magnification of actual size. Although each of the elements of the arrays are illustrated as having aligned bottom ends, it is to be understood that alternatively the midpoints of the individual elements could be aligned.

FIG. 2C shows an example of a high pass filter in accordance with the present invention having a stopband below 28 GHz and a passband from 28 to 40 GHz. The high pass filter of FIG. 2C is formed on a dielectric substrate 52 and is shown by way of example with an array of circuit elements 53, 54, 56, 58, 60, 62, 64, 66, 68, 70 and 72. Suitable dimensions and interelement spacing are illustrated in FIG. 2D for two of the elements of the high pass filter of FIG. 2C operating in the 26–40 GHz frequency range.

Figure 2D:
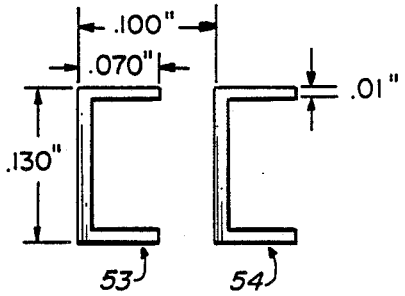
FIG. 2D is an illustration of the dimensions and interelement spacing of the elements illustrated in FIG. 2C.

The filter elements shown in FIGS. 2C and 2D are generally C-shaped such that the length of each element can be increased with respect to the length of the broadwall dimension of the waveguide within which the filter is used. In order to provide impedance matching with the waveguide the thickness of the conductors comprising the individual filter elements may be varied from element to element such that, for example, filter element 53 is thinner than filter element 60.

Figure 3:
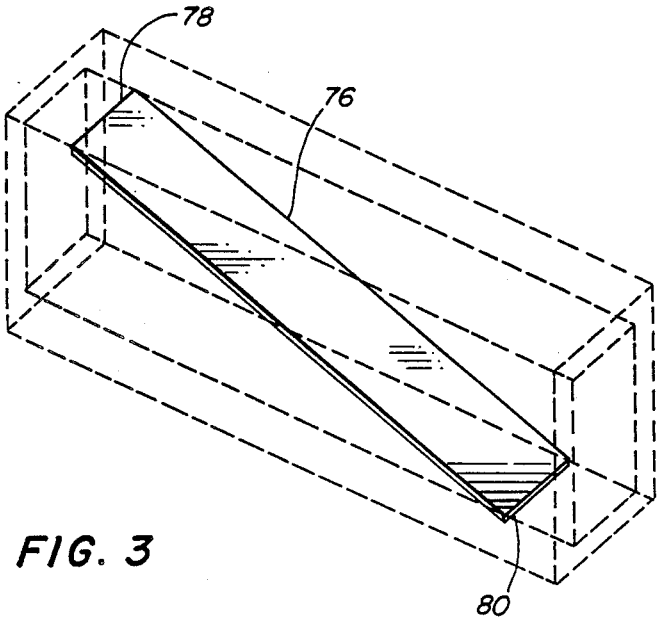
FIG. 3 is an isometric phantom top view of a section of waveguide showing a technique in accordance with the present invention for providing impedance matching of an array of filter elements constructed in accordance with the present invention.
Figure 4:
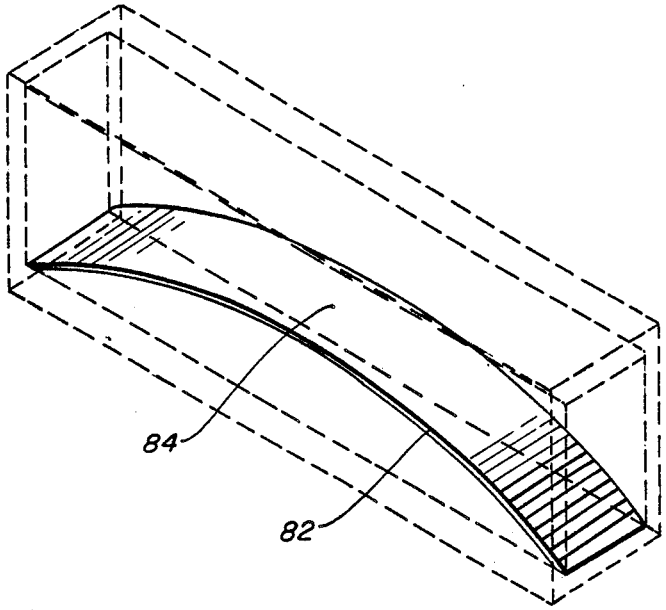
FIG. 4 is a phantom isometric view of a section of waveguide showing an alternate technique in accordance with the present invention of providing impedance matching of an array of filter elements constructed in accordance with the present invention.

FIGS. 3 and 4 illustrate alternate embodiments of the present invention for achieving impedance matching of the filter arrays of the present invention with the waveguide. For purposes of clarity of illustration neither the dielectric foam spacer material nor the filter array elements on the dielectric substrates are shown in FIGS. 3 and 4. In FIG. 3, it can be seen that the dielectric substrate 76 upon which the array of filter elements is formed may extend from the intersection 78 of the waveguide broadwalls with the waveguide narrow walls on one side of the waveguide to the intersection 80 of the waveguide broadwalls with the waveguide narrow walls on the other side of the waveguide. This type of placement of the dielectric substrate 76 provides a smooth transition and improves impedance matching. FIG. 4 illustrates an alternate technique for providing impedance matching of the filter elements of the present invention with the waveguide within which the filter elements are used. In FIG. 4 the dielectric substrate 82 is curved such that it extends from one of the waveguide narrow walls towards the center 84 of the waveguide and then back to the same waveguide narrow wall. Any of the types of arrays of elements shown in FIGS. 2A, 2B and 2C or other filters can be used on the substrate 76 in FIG. 3 or the substrate 84 in FIG. 4.

The non-contacting printed circuit filter elements disclosed herein are particularly suitable for use in the following frequency bands: $K_U$(12.4–18 GHz), K(18–26 GHz), $K_a$(26–40 GHz) U(40–60 GHz), and W(75–110 GHz). The filter elements described above are primarily intended for use for filtering signals propagating in the waveguide dominant propagation mode, i.e. the $TE_{10}$ mode although filtering with an array of elements constructed in accordance with the present invention can also be accomplished in other waveguide propagation modes, e.g. the $TE_{20}$ mode.

Obviously, many other non-contacting element configurations can be used in a similar waveguide assembly as those illustrated in the accompanying drawings and described in the foregoing specification to generate specific filter characteristics. It is further considered to be within the scope of the present invention to cascade several types of separate filter arrays combined to give specific filter or multiplexer characteristics in a multiport waveguide configuration. Further, the concept of non-contacting substrate circuits within the waveguide can also be extended within the scope of the present invention to other circuit functions in addition to filters. For instance, it should be readily understood that arrays of elements constructed in accordance with the present invention can be combined internally by means of transmission lines and semiconductors without making electrical or mechanical contact to the waveguide walls. Such "floating" circuits may, for example, function as mixers or detectors.

Obviously, many modifications and variations of the present invention are possible in the light of the above teachings. It is therefore to be understood that within the scope of the appended claims the invention may be practiced otherwise than as specifically described.

I claim:

1. A printed circuit waveguide circuit element for a waveguide having first and second broadwalls and first and second narrow walls comprising:

means for filtering signals propagated in said waveguide in a dominant waveguide propagation mode, said means for filtering comprising:

a dielectric substrate having a surface plane that is oriented parallel to said waveguide narrow walls;

a plurality of conductive elements lying in said surface plane of said dielectric substrate, there being no conductive contact between said conductive elements and said first and second waveguide broadwalls or said waveguide first and second narrow walls.

2. The circuit element of claim 1 wherein:

each of said plurality of conductive elements has a longitudinal axis, said longitudinal axis being parallel.

3. The circuit element of claim 2 wherein:

the longitudinal axes of said conductive elements are parallel to the planes of said narrow walls.

4. The circuit element of claim 3 wherein:

the longitudinal axes of said conductive elements are oblique with respect to said broadwalls.

5. The circuit element of claim 3 wherein:

the longitudinal axes of said conductive elements are orthogonal to said broadwalls.

6. The circuit element of claim 1 wherein each of said conductive elements is generally C-shaped.

7. The circuit element of claim 1 further comprising:

foam dielectric material filling the space between said dielectric substrate and said waveguide walls.

8. The circuit element of claim 1 wherein:

said dominant waveguide propagation mode is the $TE_{10}$ mode.

9. In a rectangular waveguide including first and second broadwalls and first and second narrow walls disposed orthogonal to and between said first and second broadwalls, the improvement comprising:

means for filtering signals propagated in said waveguide in a dominant waveguide propagation mode, there being no conductive contact between said means for filtering and said first and second broadwalls or said first and second narrow walls.

10. The improvement of claim 9 wherein:

said plurality of metallic elements are planar elements.

11. The improvement of claim 10 wherein:

said plurality of metallic elements are supported on a dielectric substrate.

12. The improvement of claim 11 wherein:

said dielectric substrate has a surface that is oriented orthogonal to said waveguide broadwalls.

13. The improvement of claim 12 wherein:

dielectric foam fills the space between said dielectric substrate and said first and second waveguide broadwalls and said first and second waveguide narrow walls.

14. The improvement of claim 11 wherein:

said dielectric substrate extends from said first waveguide narrow wall to said second waveguide narrow wall.

15. The improvement of claim 11 wherein:

said dielectric substrate is curved and extends from said first waveguide narrow wall to the center line of said waveguide and then back to said first waveguide narrow wall.

* * * * *